US007505733B2

(12) United States Patent
Fujimoto

(10) Patent No.: US 7,505,733 B2
(45) Date of Patent: Mar. 17, 2009

(54) BROADCAST SIGNAL RECEIVER

(75) Inventor: Masato Fujimoto, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 631 days.

(21) Appl. No.: 11/288,369

(22) Filed: Nov. 29, 2005

(65) Prior Publication Data

US 2006/0125710 A1 Jun. 15, 2006

(30) Foreign Application Priority Data

Nov. 29, 2004 (JP) ..... 2004-343990

(51) Int. Cl.
*H04H 20/71* (2008.01)

(52) U.S. Cl. ..... 455/3.01; 455/3.02; 455/179.1; 348/725

(58) Field of Classification Search ..... 455/3.01, 455/3.02; 348/725; 725/100, 72
See application file for complete search history.

(56) References Cited

U.S. PATENT DOCUMENTS

2006/0010473 A1* 1/2006 Takagi et al. ..... 725/72

FOREIGN PATENT DOCUMENTS

| | | |
|---|---|---|
| JP | 11-249763 | 9/1999 |
| JP | 2001-025149 | 1/2001 |
| JP | 2002-262448 | 9/2002 |
| JP | 2003-125023 | 4/2003 |
| JP | 2003-189467 | 7/2003 |

* cited by examiner

*Primary Examiner*—Matthew D Anderson
*Assistant Examiner*—Adel Youssef
(74) *Attorney, Agent, or Firm*—Crowell & Moring LLP

(57) ABSTRACT

In a broadcast signal receiver to which a multi-directional antenna having a plurality of signal receiving directions is connected through an antenna controller for controlling the multi-directional antenna, even when the antenna controller is erroneously connected to the broadcast signal receiver, a tuner circuit and a power supply circuit of the broadcast signal receiver is protected from over current caused by a driving voltage of the antenna controller used for switching the effective signal receiving direction of the multi-directional antenna. A polymeric protection switch is provided between a connector to which a coaxial cable connected to the antenna controller be connected and the tuner circuit.

9 Claims, 3 Drawing Sheets

BROADCAST SIGNAL RECEIVER

BACKGROUND OF THE INVENTION

1. Field of the Invention

The present invention relates to a broadcast signal receiver corresponding to multi-directional antenna.

2. Description of the Related Art

In recent years, a broadcast signal receiver called "set top box" (it is designated by a reference of STB in figures) corresponding to multi-directional antenna is put in practical use and familiarized. The multi-directional antenna is connected to the broadcast signal receiver through an antenna controller, so that an effective signal receiving direction thereof is controlled.

FIG. 3 shows a connection among the multi-directional antenna, the antenna controller and the broadcast signal receiver. The antenna controller 3 and the broadcast signal receiver 1 are connected with a modular cable 4 and a coaxial cable 5 each other. The modular cable 4 has a control signal transmission line 13 used to transmit a control signal for controlling the multi-directional antenna 2, a source voltage line 14 used to apply a predetermined source voltage, and a grounding line 15 connected to control a gland of the broadcast signal receiver 1. Broadcast signal (RF signal) received with the multi-directional antenna 2 is transmitted to the broadcast signal receiver 1 through an inside conductor of the coaxial cable 5.

The multi-directional antenna 2 is connected to the antenna controller 3 with a coaxial cable 6. An inside conductor of the coaxial cable 6 is used for transmitting the RF signal received by the multi-directional antenna 2 to the antenna controller 3, and an outside conductor thereof is used for applying a predetermined driving voltage (for example 12V) to the multi-directional antenna 2 when an effective signal receiving direction of the multi-directional antenna 2 is switched.

The coaxial cables 5 and 6 are connected to the antenna controller 3 by coaxial connectors 8 and 9. However, by specifications of the antenna controller 3, the same kinds of connectors are used for the coaxial connectors 8 and 9. Therefore, there is a possibility that the coaxial cable 5 which should be connected to the coaxial connector 8 of the antenna controller 3 may erroneously be connected to the coaxial connector 9. If such a faulty wiring is passed undetected, the driving voltage used for switching the effective signal receiving direction of the multi-directional antenna 2 is applied to a tuner circuit of the broadcast signal receiver 1, so that the tuner circuit may be damaged. In addition, an output line of the power supply of the broadcast signal receiver 1 is short circuited to the ground, so that an over current flows to the power source circuit and so on of the broadcast signal receiver 1, and the broadcast signal receiver will break down.

By the way, Japanese Laid-Open Patent Publication No. 11-249763 shows a computer which supplies a power to a monitor display apparatus after confirming that the computer and the monitor display apparatus are properly connected. In addition, Japanese Laid-Open Patent Publications No. 2003-125023, No. 2001-25149, No. 2002-262448, and No. 2003-189467 respectively show a technique to intercept the over current by a polymeric protection switched.

SUMMARY OF THE INVENTION

The present invention is made to solve the above-mentioned conventional problems, and purposes to provide a broadcast signal receiver which can protect a tuner circuit and a power source circuit of a broadcast signal receiver from an over current even when a drive voltage used for switching an effective signal receiving direction of a multi-directional antenna is applied to an outside conductor of a coaxial cable connected to the broadcast signal receiver due to faulty wiring.

A broadcast signal receiver to which a multi-directional antenna having a plurality of signal receiving directions is connected through an antenna controller for controlling the multi-directional antenna in accordance with an aspect of the present invention comprises:

a tuner circuit for receiving broadcast signal through the multi-directional antenna and the antenna controller;

a demodulation circuit for demodulating received broadcast signal;

a power supply circuit for supplying electric power to at least the tuner circuit and the demodulation circuit;

a control unit for control each department of the broadcast signal receiver;

a coaxial connector to which a first coaxial cable used for connecting between the antenna controller and the broadcast signal receiver is connected; and an over current interruption switch provided between the coaxial connector and the tuner circuit for interrupting an over current flowing toward the tuner circuit, thereby when a second coaxial cable used for connecting between the antenna controller and the multi-directional antenna is erroneously connected to the coaxial connector and a drive voltage used for switching the effective signal receiving direction of the multi-directional antenna is applied to the coaxial connector, the over current due to the drive voltage is interrupted by the over current interruption switch so that the tuner circuit is protected from the over current.

By such a configuration, even when the drive voltage used for switching the effective signal receiving direction of the multi-directional antenna is applied to the coaxial connector from the antenna controller caused by faulty wiring of the first coaxial cable, the over current interruption switch interrupts the over current due to the drive voltage and flowing toward the tuner circuit, so that the tuner circuit is protected from the over current. Consequently, it is possible to prevent the break out of the broadcast signal receiver due to faulty wiring.

In the above-mentioned broadcast signal receiver, it is preferable that the over current interruption switch is a polymeric protection switch having a characteristic to change to non-conduction state when a temperature thereof is increased by heat due to over current and to return to conductive state when the temperature thereof is decreased.

Since polymeric protection switch can easily be returned to the conduction state, the operator can easily re-connects the antenna controller and the broadcast signal receiver without any troublesome operation.

Furthermore, it is preferable that the coaxial connector is mounted on a chassis of the broadcast signal receiver via an insulation member so that the over current due to the drive voltage never flows toward the power supply circuit, thereby the power supply circuit is protected from the over current.

Still furthermore, it is preferable that the control circuit detects the drive voltage applied to the coaxial connector and shuts off output of the power supply circuit. Thereby, safety of the broadcast signal receiver can be increased.

Still furthermore, it is preferable that the drive voltage is supplied through an outside conductor of the second coaxial cable, and the over current interruption switch is connected to an outside terminal of the coaxial connector. Since the drive voltage for switching the effective signal receiving direction of the multi-directional antenna is supplied through the outside conductor of the second coaxial cable, the over current flows from the outside terminal of the coaxial connector to the tuner circuit. By such a configuration, the over current due to the drive voltage can be interrupted, surely.

DETAILED DESCRIPTION OF THE EMBODIMENT

Figure 1:
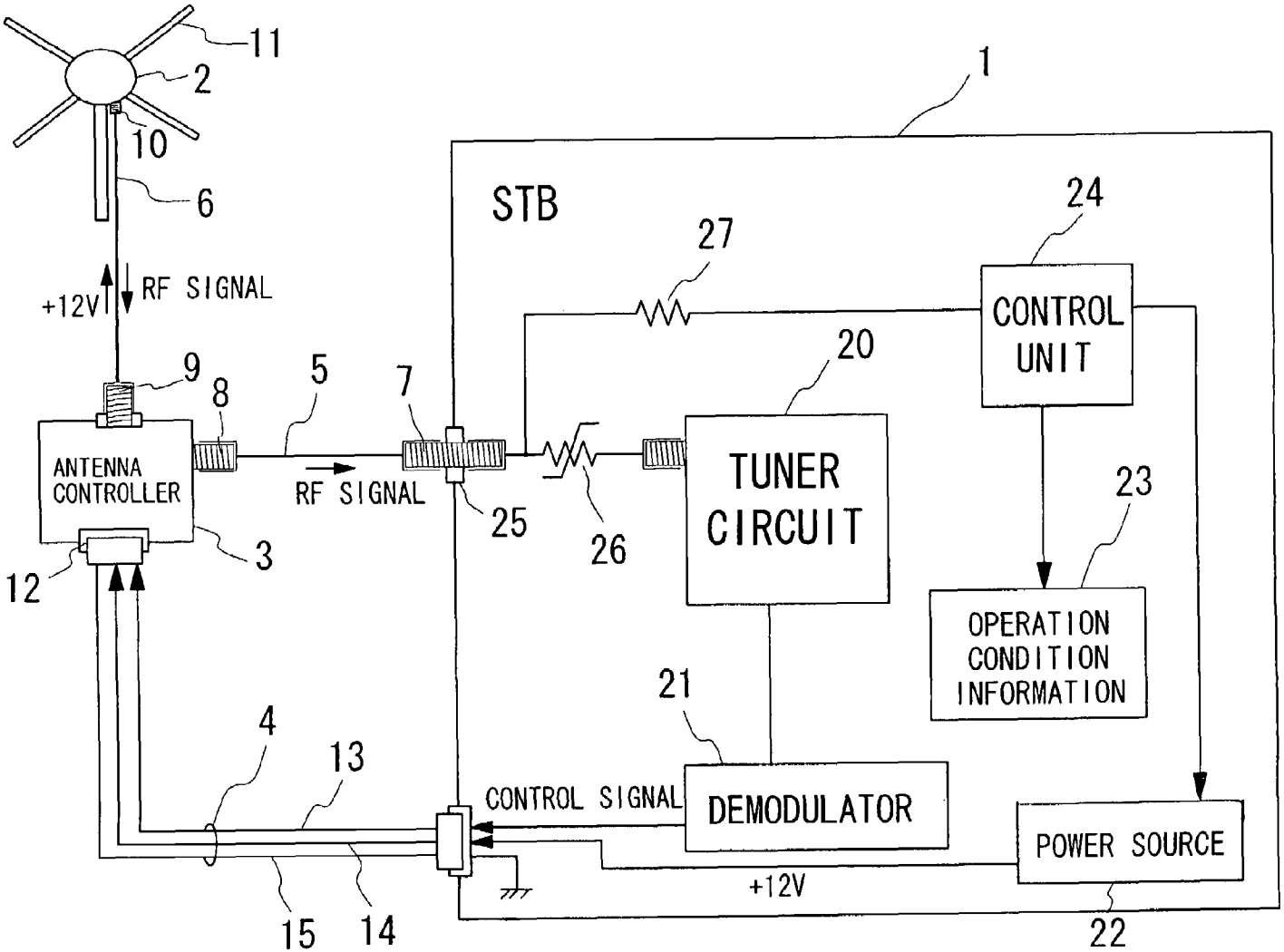
FIG. 1 is a block diagram showing a configuration of a broadcast signal receiver (STB) and a state that a multi-directional antenna and an antenna controller are normally connected to the broadcast signal receiver in accordance with an embodiment of the present invention.

A broadcast signal receiver (STB) in accordance with an embodiment of the present invention is described with reference to the figures. FIG. 1 shows a configuration of a broadcast signal receiver 1 and a state that a multi-directional antenna and an antenna controller are normally connected to the broadcast signal receiver 1.

A multi-directional antenna 2 having plural signal receiving directions is connected to the broadcast signal receiver 1 through an antenna controller (antenna control means) 3. The broadcast signal receiver 1 and the antenna controller 3 are connected by a modular cable 4 and a first coaxial cable 5. The multi-directional antenna 2 and the antenna controller 3 are connected by a second coaxial cable 6.

The first coaxial cable 5 is connected between a first coaxial connector 7 provided on the broadcast signal receiver 1 and a second coaxial connector 8 provided on the antenna controller 3. On the other hand, the second coaxial cable 6 is connected between a third coaxial connector 9 provided on the antenna controller 3 and a fourth coaxial connector 10 provided on the multi-directional antenna 2.

The multi-directional antenna 2 has four antennas 11 which are respectively arranged so that directivities of them are respectively directed different directions at an angular interval of about 90 degrees. The effective signal receiving direction of the multi-directional antenna 2 is switched by selecting an output signal among a plurality of output signals directly outputted from the antennas 11 and output signals outputted from combinations of two antennas 11, and outputting the selected output signal to the antenna controller 3. A drive voltage (12V) which is used to switch the effective signal receiving direction of the multi-directional antenna 2 is applied to the multi-directional antenna 2 from the antenna controller 3 through an outside conductor of the second coaxial cable 6. An RF signal received by the multi-directional antenna 2 is transmitted to the antenna controller 3 through an inside conductor of the second coaxial cable 6.

The antenna controller 3 has a modular connector 12 to which the modular cable 4 is connected and the second and third coaxial connectors 8 and 9 to which the first and second coaxial cables 5 and 6 are respectively connected. The antenna controller 3 controls the directivity of the multi-directional antenna 2 corresponding to a control signal outputted from the broadcast signal receiver 1, and transfers to the RF signals transmitted from the multi-directional antenna 2 to the broadcast signal receiver 1.

The modular cable 4 has a control signal transmission line 13 used for transmitting the control signal for controlling the multi-directional antenna 2, a power source voltage line 14 used for supplying a voltage of power source having a predetermined voltage (for example, 12V) to the antenna controller 3, and a grounding line 15 connected to the ground of the broadcast signal receiver 1.

An inside conductor of the first coaxial cable 5 transmits the RF signal which is transmitted from the multi-directional antenna 2 to the antenna controller 3 through the inside conductor of the second coaxial cable 6 to the broadcast signal receiver 1. An outside conductor of the first coaxial cable 5 is connected to the ground of the antenna controller 3 through an outside terminal of the second coaxial connector 8.

The broadcast signal receiver 1 comprises the first coaxial connector 7 to which the first coaxial cable 5 is connected, a tuner circuit 20 receiving the RF signal through the first coaxial connector 7, a demodulator (a signal demodulating circuit) 21 for demodulating the RF signal received by the tuner circuit 20, a power supply circuit 22 for supplying electric power to the tuner circuit 20, the demodulator 21, and so on, an operation condition informing unit 23 for informing operation conditions of each department of the broadcast signal receiver 1 to a user by image or voice, and a control unit (control means) 24 constituted by a CPU and so on for controlling each department of the broadcast signal receiver 1.

The first coaxial connector 7 is mounted on a chassis of the broadcast signal receiver 1 via an insulation member 25 which insulates the outside terminal of the first coaxial connector 7 from the ground of the broadcast signal receiver 1. A polymeric protection switch (over current interruption switch or interruption means) 26, for example, PolySwitch (trade mark of Raychem Circuit Protection) is between the first coaxial connector 7 and the tuner circuit 20 for interrupting current by heat caused by over current. Since the polymeric protection switch 26 has a characteristic to change to non-conduction state when a temperature thereof is increased by heat due to over current and to return to conductive state again when the temperature thereof is decreased to a predetermined temperature, it is easy to return from the faulty wiring. The first coaxial connector 7 is further connected to the control unit 24 through a resistor 27.

Figure 2:
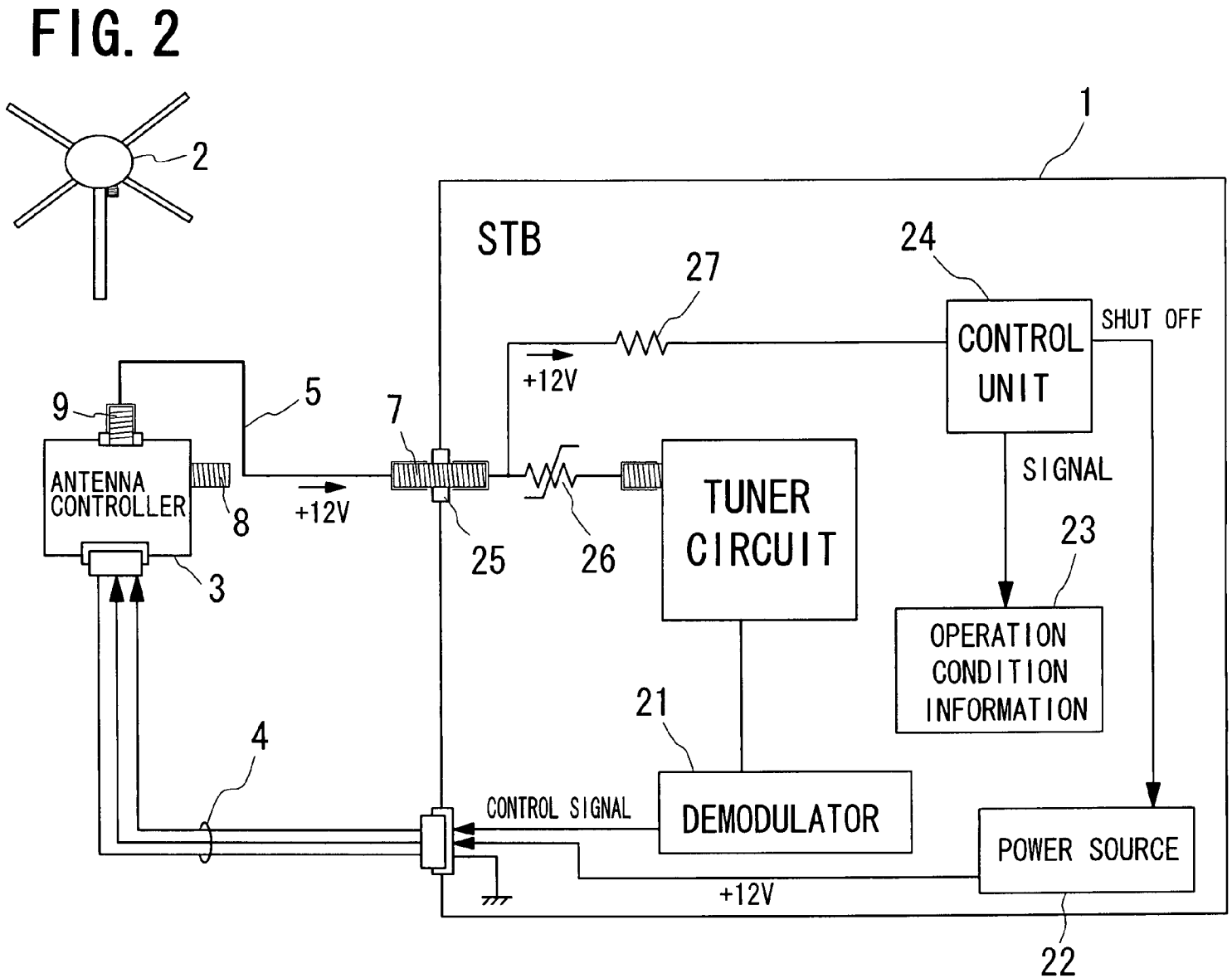
FIG. 2 is a block diagram showing a state that the multi-directional antenna and the antenna controller are erroneously connected to the broadcast signal receiver in the embodiment.
Figure 3:
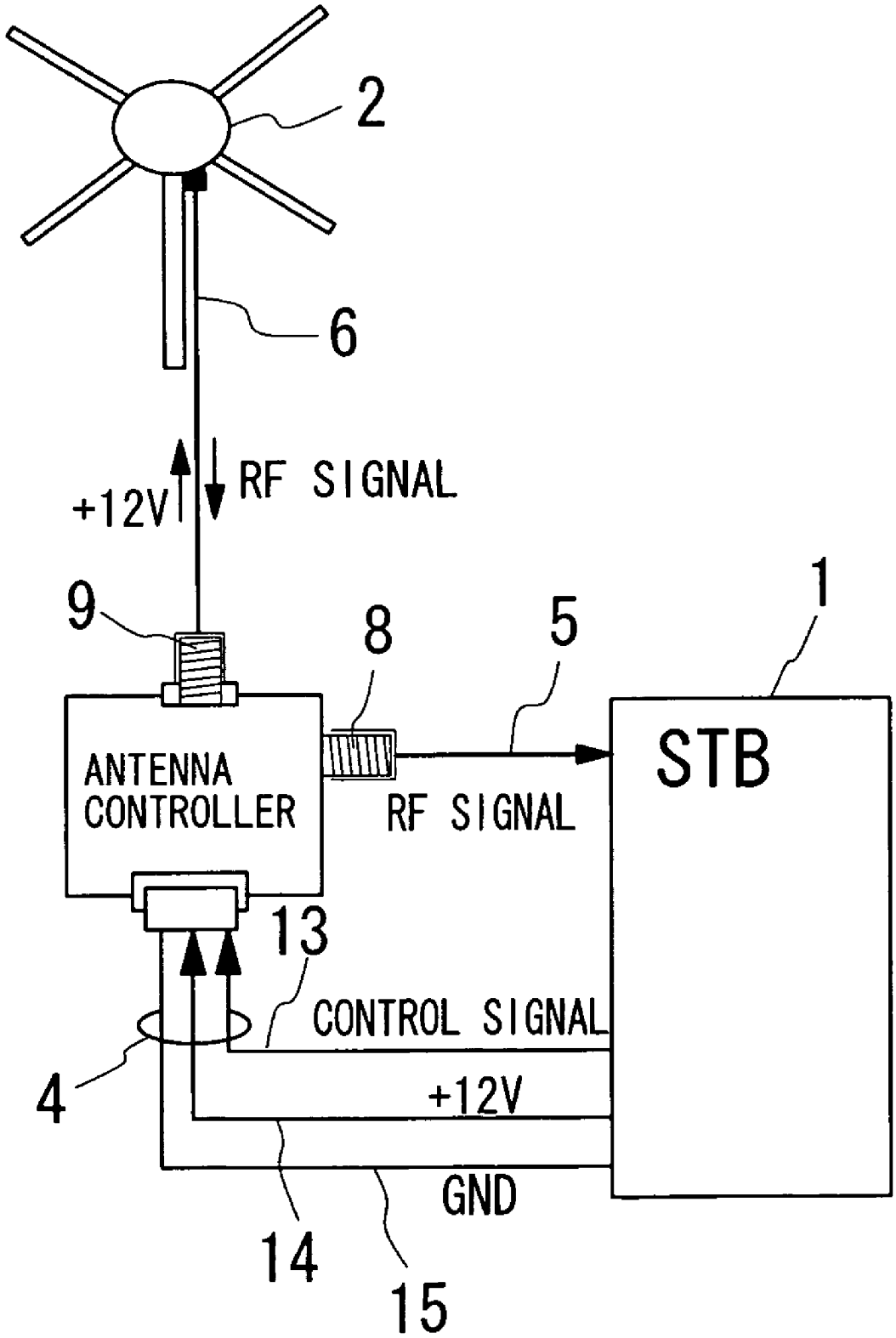
FIG. 3 (PRIOR ART)
FIG. 3 is a diagram showing a state that a multi-directional antenna and an antenna controller are connected to a conventional broadcast signal receiver.

FIG. 2 shows a state that the terminal of the first coaxial cable 5 which should be connected to the second coaxial connector 8 is erroneously connected to the third coaxial connector 9 in the antenna controller 3. In such a case, the drive voltage (12V) used for switching the effective signal receiving direction of the multi-directional antenna 2 will be applied to the outside terminal of the first coaxial connector 7. The polymeric protection switch 26, however, is provided between the first coaxial connector 7 and the tuner circuitry 20 in this embodiment, so that the over current flowing toward the tuner circuit 20 is interrupted by the polymeric protection switch 26, and thereby, the tuner circuit 20 is protected from the over current. On the other hand, the control unit 24 can be detected that the drive voltage is applied to the outside terminal of the first coaxial connector 7 from a voltage between both ends of the resistor 27, so that the control unit 24 shuts off the output of the power source circuit 22 and outputs a signal informing that the antenna controller 3 is erroneously connected to the broadcast signal receiver 1 to the operation condition informing unit 23. The operation condition informing unit 23 which receives the signal displays a predetermined message or to output a predetermined voice message to an operator, so that the faulty wiring is informed to the operator.

As mentioned above, according to the broadcast signal receiver in accordance with this embodiment, even when the drive voltage used for switching the effective signal receiving direction of the multi-directional antenna 2 is applied to the outside terminal of the first coaxial connector 7 due to the faulty wiring, the over current flowing toward the tuner circuit 20 is interrupted by the polymeric protection switch 26, so that the tuner circuit can be protected from the over current. Furthermore, the first coaxial connector 7 is mounted on the chassis of the broadcast signal receiver 1 via the insulation member 25, so that the output line of the power supply circuit 22 may not be short circuited to the ground of the broadcast signal receiver 1, and thereby the power supply circuit 22 can be protected from the over current, although the faulty wiring. Still furthermore, the control unit 24 shuts off the output of the power supply circuit 22 when it detects the drive current applied to the outside terminal of the first coaxial connector 7, so that safety of the broadcast signal receiver 1 can be increased. Still furthermore, the fact that the antenna controller 3 is erroneously connected to the broadcast signal receiver 1 to an operator by the operation condition informing unit 23, so that the operator who awakes to the faulty wiring can retrace the wiring.

The present invention is not limited to the configuration of the above-mentioned embodiment, and it can be modified in various manners. As for the element provided between the first coaxial connector 7 and the tuner circuit 20 used for interrupting the over current flowing toward the tuner circuit 20, the polymeric protection switch 26 is desirable, but it is not limited to the polymeric protection switch 26. Another element which can interrupt or shut off the over current can be used instead of the polymeric protection switch 26.

In addition, it is possible to constitute an operation program of the control unit 24 so as to perform alternative of shutting off the output of the power supply circuit 22 and displaying a predetermined message on the operation condition informing unit 23, when the control unit 24 detects the abnormal voltage on the outside terminal of the first coaxial connector 7.

This application is based on Japanese patent application 2004-343990 filed Nov. 29, 2004 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A broadcast signal receiver to which a multi-directional antenna having a plurality of signal receiving directions is connected through an antenna controller for controlling the multi-directional antenna comprising:

a tuner circuit for receiving broadcast signal through the multi-directional antenna and the antenna controller;

a demodulation circuit for demodulating received broadcast signal;

a power supply circuit for supplying electric power to at least the tuner circuit and the demodulation circuit;

a control unit for control each department of the broadcast signal receiver;

a coaxial connector to which a first coaxial cable used for connecting between the antenna controller and the broadcast signal receiver is connected; and an over current interruption switch provided between the coaxial connector and the tuner circuit for interrupting an over current flowing toward the tuner circuit, thereby when a second coaxial cable used for connecting between the antenna controller and the multi-directional antenna is erroneously connected to the coaxial connector and a drive voltage used for switching the effective signal receiving direction of the multi-directional antenna is applied to the coaxial connector, the over current due to the drive voltage is interrupted by the over current interruption switch so that the tuner circuit is protected from the over current.

2. The broadcast signal receiver in accordance with claim 1, wherein the over current interruption switch is a polymeric protection switch having a characteristic to change to non-conduction state when a temperature thereof is increased by heat due to over current and to return to conductive state when the temperature thereof is decreased.

3. The broadcast signal receiver in accordance with claim 1, wherein the coaxial connector is mounted on a chassis of the broadcast signal receiver via an insulation member so that the over current due to the drive voltage never flows toward the power supply circuit, thereby the power supply circuit is protected from the over current.

4. The broadcast signal receiver in accordance with claim 1, wherein the control circuit detects the drive voltage applied to the coaxial connector and shuts off output of the power supply circuit.

5. The broadcast signal receiver in accordance with claim 1, wherein the drive voltage is supplied through an outside conductor of the second coaxial cable, and the over current interruption switch is connected to an outside terminal of the coaxial connector.

6. A broadcast signal receiver to which a multi-directional antenna having a plurality of signal receiving directions is connected through an antenna control means for controlling the multi-directional antenna, wherein the broadcast signal receiver comprising a tuner circuit for receiving broadcast signal through the multi-directional antenna and the antenna control means, a demodulation circuit for demodulating received broadcast signal, a power supply circuit for supplying electric power to at least the tuner circuit and the demodulation circuit, and a control means for control each department of the broadcast signal receiver;

the antenna control means and the broadcast signal receiver is connected with a modular cable having a control signal transmission line used to transmit a control signal for controlling the multi-directional antenna, a source voltage line used to apply a predetermined source voltage to the antenna control means from the power supply circuit, and a grounding line connected to a gland of the broadcast signal receiver, and with a first coaxial cable used to transmit broadcast signal received with the multi-directional antenna to the broadcast signal receiver;

the multi-directional antenna is connected to the antenna control means through a second coaxial cable to transmit received broadcast signal to the antenna control means, and applied a predetermined drive voltage used switch the effective signal receiving direction through an outside conductor of the second coaxial cable;

the first coaxial cable is connected to a first coaxial connector provided on the broadcast signal receiver, and connected to a second coaxial connector provided on the antenna control means;

the second coaxial cable is connected to a third coaxial connector provided on the antenna control means, and connected to a fourth coaxial connector provided on the multi-directional antenna;

the first coaxial connector is mounted on a chassis of the broadcast signal receiver via an insulation member for insulating an outside terminal of the first coaxial connector from the ground of the broadcast signal receiver;

an over current interruption means is further provided between the first coaxial connector and the tuner circuit for interrupting an over current flowing toward the tuner circuit; and when the first coaxial cable is erroneously connected between the first coaxial connector and the third coaxial connector and the drive voltage used for switching the effective signal receiving direction of the multi-directional antenna is applied to the outside terminal of the first coaxial connector, the over current interruption means interrupts the over current flowing toward the tuner circuit due to the drive voltage so that the tuner circuit is protected from the over current.

7. The broadcast signal receiver in accordance with claim 6, wherein the over current interruption means is a polymeric protection switch having a characteristic to change to non-conduction state when a temperature thereof is increased by heat due to over current and to return to conductive state when the temperature thereof is decreased.

8. The broadcast signal receiver in accordance with claim 6, wherein the control circuit detects the drive voltage applied to the coaxial connector and shuts off output of the power supply circuit.

9. A broadcast signal receiver to which a multi-directional antenna having a plurality of signal receiving directions is connected through an antenna control means for controlling the multi-directional antenna, wherein the broadcast signal receiver comprising a tuner circuit for receiving broadcast signal through the multi-directional antenna and the antenna control means, a demodulation circuit for demodulating received broadcast signal, a power supply circuit for supplying electric power to at least the tuner circuit and the demodulation circuit, and a control means for control each department of the broadcast signal receiver;

the antenna control means and the broadcast signal receiver is connected with a modular cable having a control signal transmission line used to transmit a control signal for controlling the multi-directional antenna, a source voltage line used to apply a predetermined source voltage to the antenna control means from the power supply circuit, and a grounding line connected to a gland of the broadcast signal receiver, and with a first coaxial cable provided in parallel with the modular cable and used to transmit broadcast signal received with the multi-directional antenna to the broadcast signal receiver;

the multi-directional antenna is connected to the antenna control means through a second coaxial cable to transmit received broadcast signal to the antenna control means, and applied a predetermined drive voltage used switch the effective signal receiving direction through an outside conductor of the second coaxial cable;

the first coaxial cable is connected to a first coaxial connector provided on the broadcast signal receiver, and connected to a second coaxial connector provided on the antenna control means;

the second coaxial cable is connected to a third coaxial connector provided on the antenna control means, and connected to a fourth coaxial connector provided on the multi-directional antenna;

the first coaxial connector is mounted on a chassis of the broadcast signal receiver via an insulation member for insulating an outside terminal of the first coaxial connector from the ground of the broadcast signal receiver;

a polymeric protection switch having a characteristic to change to non-conduction state when a temperature thereof is increased by heat due to over current and to return to conductive state when the temperature thereof is decreased and provided between the first coaxial connector and the tuner circuit, a resistor provided between the control means and the first coaxial connector, and an operation condition informing means controlled by the control means and informing operation conditions of each department of the broadcast signal receiver to a user are further provided; and thereby when the first coaxial cable is erroneously connected between the first coaxial connector and the third coaxial connector and the drive voltage used for switching the effective signal receiving direction of the multi-directional antenna is applied to the outside terminal of the first coaxial connector, the polymeric protection switch interrupts the over current flowing toward the tuner circuit due to the drive voltage so that the tuner circuit is protected from the over current;

the control means detects the drive voltage applied to the outside terminal of the first coaxial connector, and shuts off the output of the power supply circuit, and controls the operation condition informing means so as to inform a fact that the antenna control means and the broadcast signal receiver are erroneously connected to the user.

* * * * *